US005479871A

United States Patent [19]

Fox et al.

[11] Patent Number: 5,479,871

[45] Date of Patent: Jan. 2, 1996

[54] EMERGENCY POWER SYSTEM FOR SUBMARINES

[75] Inventors: Robert F. Fox, Westerly, R.I.; Craig R. Dawson, Norwich, Conn.

[73] Assignee: General Dynamics Corporation, Falls Church, Va.

[21] Appl. No.: 161,793

[22] Filed: Dec. 3, 1993

[51] Int. Cl.[6] ..... B63G 8/36

[52] U.S. Cl. ..... 114/334; 114/339

[58] Field of Search ..... 114/337–339, 334, 114/162, 278, 332, 335; 440/89

[56] References Cited

U.S. PATENT DOCUMENTS

| | | | |
|---|---|---|---|
| 953,146 | 3/1910 | Jaubert | 114/337 X |
| 1,072,393 | 9/1913 | Spear et al. | 114/334 |
| 1,315,533 | 9/1919 | Spear | 114/335 |
| 2,247,595 | 7/1941 | Besler | 60/6 |
| 2,377,442 | 6/1945 | Osterhoudt | 114/332 X |
| 2,870,608 | 1/1959 | Comyns-Carr | 60/59 |
| 2,882,687 | 4/1959 | Stivender | 60/59 |
| 3,008,889 | 11/1961 | Junkins | 204/193.2 |
| 3,102,852 | 9/1963 | Schenck, Jr. | 204/193.2 |
| 3,118,818 | 1/1964 | Bray | 176/39 |
| 3,224,199 | 12/1965 | Best | 60/59 |
| 3,601,980 | 8/1971 | Faber | 60/11 |
| 3,601,989 | 8/1971 | Austin | 60/221 |
| 3,648,635 | 3/1972 | Hashemi | 114/337 X |

FOREIGN PATENT DOCUMENTS

| | | |
|---|---|---|
| 302508 | 8/1988 | European Pat. Off. . |

*Primary Examiner*—Sherman Basinger

*Attorney, Agent, or Firm*—Brumbaugh, Graves Donohue & Raymond

[57] ABSTRACT

An emergency power generation system mounted in the aft portion of a submarine includes a gas turbine arranged to drive a generator and an exhaust gas outlet in the rudder structure of the submarine to reduce submarine construction cost and avoid contamination of the fresh air supply for the submarine.

4 Claims, 2 Drawing Sheets

EMERGENCY POWER SYSTEM FOR SUBMARINES

BACKGROUND OF THE INVENTION

This invention relates to emergency power generating systems for submarines and, more specifically, to a new improved emergency power generating system for a submarine which avoids the drawbacks of conventional emergency power systems.

Conventional nuclear submarines incorporate diesel-powered emergency power generation systems to supply relatively long term emergency power in the event of a breakdown or incapacity of the main nuclear propulsion plant. The diesel engines used for this purpose are large, heavy, relatively expensive and require several supporting systems such as sea water cooling, air start, etc. which all contribute to an increase in submarine construction costs. In addition, the magnitude and complexity of the moving parts associated with a diesel engine produce both reliability and maintenance issues.

Typically, nuclear submarine designs provide a fresh air intake which extends from the top of the fairwater and distributes fresh air throughout the ship via the ventilation system. The emergency diesel engine draws air from the ship's ventilation system which is coupled directly to the diesel engine. The diesel exhaust system discharges the combustion gases out of the ship via a sail plenum. Occasionally, the proximity of the diesel exhaust plenum to the ship's fresh air intake has introduced diesel exhaust into the fresh air intake thereby contaminating the air inhaled by ship personnel throughout the submarine.

In addition, current emergency diesel generator systems incorporate sea water cooling to provide a heat sink for both the generator and the diesel engine. Conventional designs locate the diesel generator in the forward section of the ship, thereby requiring sea water hull penetrations and resulting in both an increase in ship cost and a greater risk of flooding.

SUMMARY OF THE INVENTION

Accordingly, it is an object of the present invention to provide an emergency submarine power supply arrangement which overcomes the cost and disadvantages of the prior art.

Another object of the invention is to provide an improved emergency power generation system for nuclear submarines which is less expensive, more reliable, and more easily maintained than conventional systems and eliminates the problems associated with the discharge of exhaust gases in proximity to the ship's accessible areas topside.

These and other objects of the invention are attained by providing an emergency power system for submarines including a gas turbine installed in the aft portion of the submarine and an exhaust vent for the turbine provided in the rudder structure of the submarine. With this arrangement, the emergency power supply is relatively light, compact, and more cost effective.

Gas turbines have conventionally not been considered for use in submarines because of the inefficiencies resulting from discharging the exhaust to a high sea water backpressure and the large air volume required for combustion. In this regard, the claimed invention avoids the decreased efficiency of a gas turbine operating at an elevated backpressure by limiting gas turbine operations to the surfaced condition of the submarine. In addition, greater air flow is provided by enlarging the main induction pipe in the submarine fairwater.

BRIEF DESCRIPTION OF THE DRAWINGS

Further objects and advantages of the present invention will be more fully appreciated from a reading of the following detailed description when considered with the accompanying drawing wherein.

DESCRIPTION OF PREFERRED EMBODIMENTS

Figure 1:
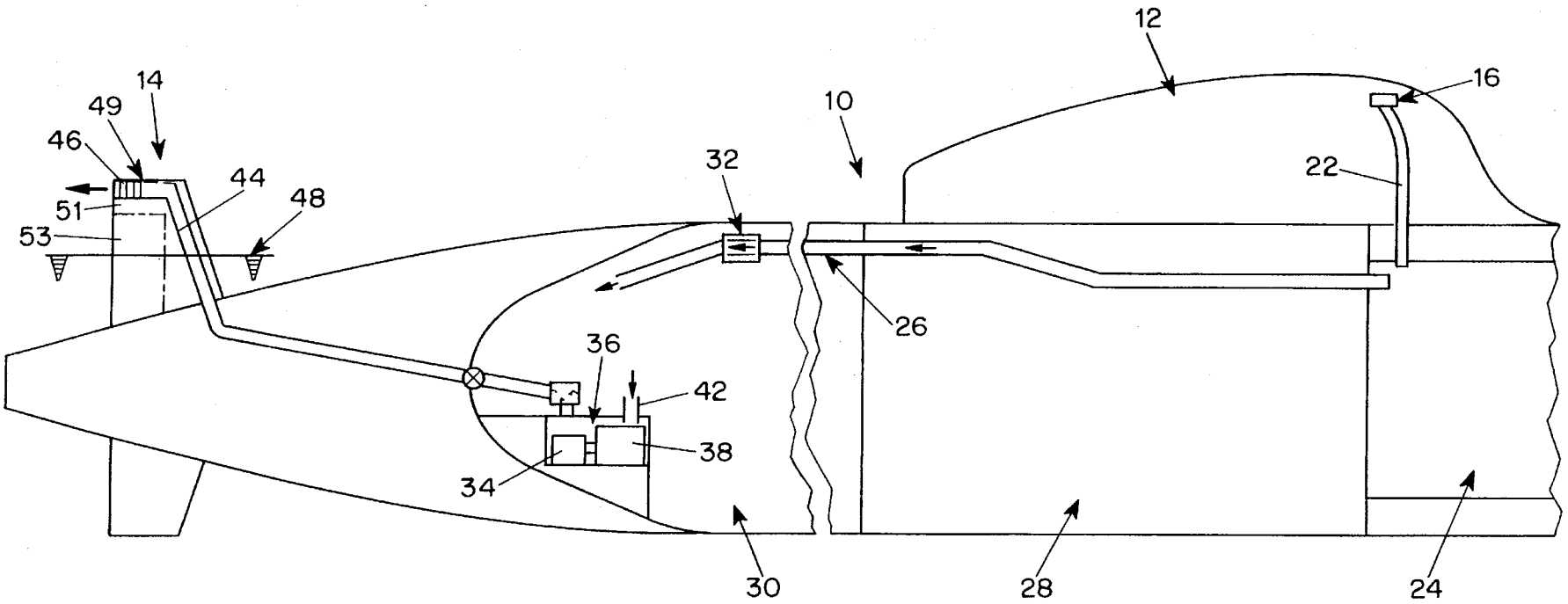
FIG. 1 is a fragmentary schematic view in elevation showing the aft portion of a submarine to illustrate an emergency power system in accordance with the invention.

In the representative embodiment of the invention illustrated schematically in FIG. 1, a submarine 10 has a generally centrally located fairwater 12 and a rudder structure 14 at the aft end of the vessel. Fresh air for personnel in the submarine is drawn through an induction intake 16 located in the submarine fairwater 12. A main induction duct 22 conducts the fresh air from the intake 16 into a forward compartment 24 of the vessel and a further duct 26 directs air through a nuclear reactor compartment 28 to the engine room 30. A fan 32 is mounted in the duct 26 to draw the fresh air into the engine room 30. Since a gas turbine engine requires about 25% more air than a diesel engine, the induction duct 22 may be enlarged to provide greater air flow.

Figure 2:
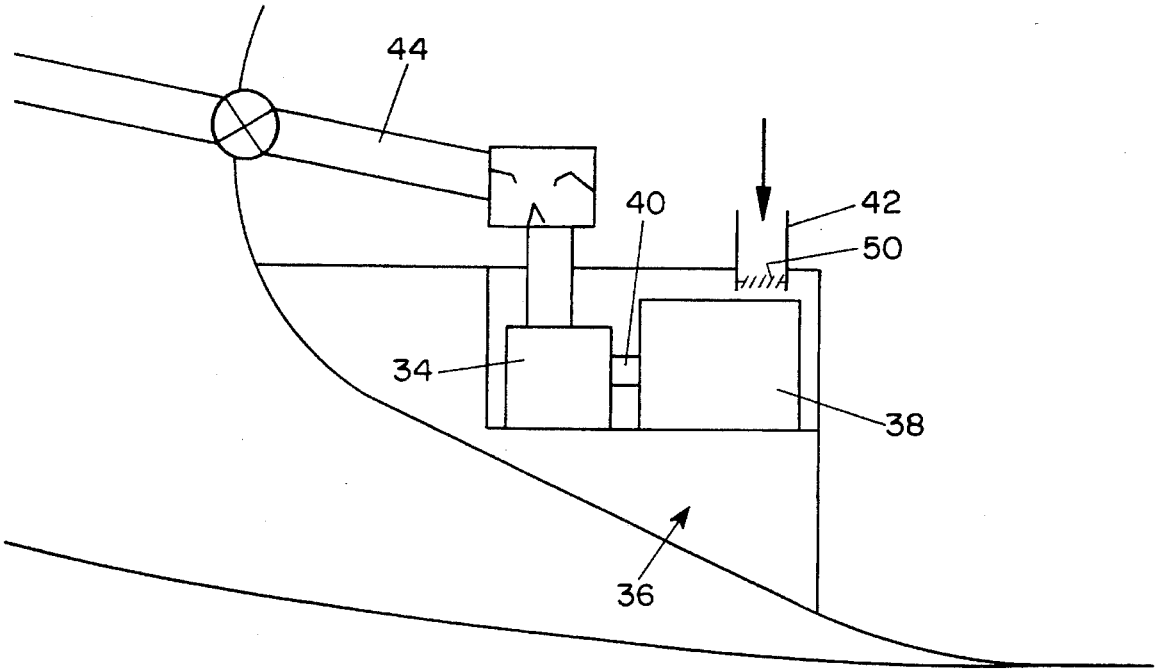
FIG. 2 is an enlarged fragmentary schematic view showing a portion of the emergency power system illustrated in FIG. 1.

In accordance with the invention, a gas turbine 34 is mounted in a section 36 of the engine room 30 and, as best seen in FIG. 2, is connected in driving relation to a conventional electrical generator 38 by a connecting shaft 40, the generator 38 being arranged to supply electrical power to the electrical components of the submarine. The turbine 34 may be any suitable gas turbine capable of supplying the necessary power to drive the generator 38 such as a conventional industrial or aircraft gas turbine, for example. If desired, the section 36 of the engine room 30 may be a section of an aft trim tank of the submarine.

A particularly suitable gas turbine and generator arrangement includes a gas turbine having a continuous rating of 1000 hp and a 30-minute rating of 1300 hp in combination with a generator which can provide 876 kva of dc power having a continuous rating in combination with the 1000 hp turbine of 746 kw. A preferred arrangement includes a Textron Lycoming T53-L-703 marine/industrial gas turbine driving a Westinghouse electric generator. This 1000 hp gas turbine weighs 960 pounds as compared with a comparable 1500 hp diesel system weight of 31,000 pounds. Fuel oil tankage capacity is provided for the gas turbine to run continuously for 10 days.

Combustion air for the gas turbine is drawn into the turbine-generator section 36 from the engine room 30 through an opening 42 and exhaust gases from the turbine are conveyed through a duct 44 to the rudder structure 14 at the aft end of the vessel where they are discharged through a rearwardly-directed plenum 46 located at the top of the upper rudder structure 49 above the surfaced water line 48. The upper rudder structure 49 comprises a flapped rudder portion 53 and a fixed portion 51. The fixed rudder portion 51 contains a duct 44 and plenum 46. The flapped portion 53 is movable and smaller than all movable upper rudder structures conventionally used in submarines. Consequently, the normal force developed from movement through sea water is reduced and the tactical diameter, i.e., turning diameter, is about 25% greater than in conventional submarines.

With the gas turbine located in an aft compartment, the same sea water intake for the steam plant cooling water may be used to cool the gas turbine, if necessary, rather than requiring a separate sea water intake for that purpose. Additionally, exhaust for the emergency power supply is completely removed from the region of the fresh air intake for the vessel, thereby eliminating the danger of contaminating the fresh air circulated through the ship and inhaled by ship personnel with exhaust gases or exposing personnel on the deck to exhaust gases.

As best seen in FIG. 2, the combustion air for the gas turbine 34 is drawn into the section 36 through the opening 42 which is at the forward end of the section 36 so that the combustion air passes the generator 38 and the turbine 34 to provide a cooling effect before being used for combustion. Moreover, the opening 42 leading into the section 36 may be provided with appropriate louvers 50 to direct the air entering that section in any desired manner. Such cooling of the auxiliary power supply components by the combustion air can eliminate the requirement for any auxiliary cooling system.

In the event of a breakdown of the main nuclear propulsion plant in the reactor compartment 28, the submarine surfaces and draws fresh air into the ship's ventilation inductor 16 which passes through the ducts 22, 26 and opening 42 and is supplied to the gas turbine 34. Operation of the gas turbine 34 drives the generator 38, thereby providing emergency power to the submarine. The gas turbine exhaust is discharged through the duct 44 and the plenum 46 in the rudder structure 14 at a location above the surface of the sea water.

A gas turbine emergency power generation system in accordance with the invention is smaller in size and lighter in weight than conventional diesel engines, thereby providing equivalent emergency power for the submarine while taking up a minimum amount of space. In addition, the gas turbine emergency power generation system in accordance with the invention provides increased reliability and requires less maintenance and support systems compared to diesel systems which contain more moving parts. Moreover, location of the emergency power system in the aft portion of the ship in proximity of existing sea water cooling systems minimizes support system requirements.

Although the invention has been described herein with reference to specific embodiments, many modifications and variations therein will readily occur to those skilled in the art. Accordingly, all such variations and modifications are included within the intended scope of the invention.

We claim:

1. An emergency power system for a submarine having an aft portion and a rudder structure comprising a gas turbine mounted in the aft portion of the submarine and exhaust gas duct means extending from the gas turbine to the rudder structure for ejecting gas turbine exhaust gases from the submarine, the rudder structure comprising an upper rudder structure and lower rudder structure, the upper rudder structure having a fixed portion and a movable flapped portion, the fixed portion including an exhaust gas plenum at the top thereof to receive exhaust gases from the exhaust gas duct means, and wherein the gas turbine is mounted in a section in an aft trim tank.

2. An emergency power system according to claim 1 wherein the gas turbine is mounted in a closed section of the submarine and including a louvered opening communicating with the closed section to provide combustion air to the gas turbine.

3. An emergency power system according to claim 2 including a fresh air intake for the submarine located in a fairwater remote from the exhaust gas plenum at the top of the fixed portion of the rudder structure,

4. An emergency power system according to claim 3 including fresh air ventilation duct means in the submarine for directing air from the fresh air intake to the aft portion of the submarine in which the gas turbine is mounted.

* * * * *